US006921473B2

(12) United States Patent
Ward-Close et al.

(10) Patent No.: US 6,921,473 B2
(45) Date of Patent: Jul. 26, 2005

(54) ELECTROLYTIC REDUCTION OF METAL OXIDES SUCH AS TITANIUM DIOXIDE AND PROCESS APPLICATIONS

(75) Inventors: Charles M Ward-Close, Farnborough (GB); Alistair B Godfrey, Farnborough (GB)

(73) Assignee: Qinetiq Limited, Hants (GB)

( * ) Notice: Subject to any disclaimer, the term of this patent is extended or adjusted under 35 U.S.C. 154(b) by 204 days.

(21) Appl. No.: 10/204,547

(22) PCT Filed: Feb. 20, 2001

(86) PCT No.: PCT/GB01/00683

§ 371 (c)(1),
(2), (4) Date: Sep. 6, 2002

(87) PCT Pub. No.: WO01/62996

PCT Pub. Date: Aug. 30, 2001

(65) Prior Publication Data

US 2003/0047463 A1 Mar. 13, 2003

(30) Foreign Application Priority Data

Feb. 22, 2000 (GB) ..... 0003971
May 8, 2000 (GB) ..... 0010873

(51) Int. Cl.[7] ..... C25C 3/00; C25C 3/04; C25C 3/06; C25C 3/26; C25C 3/28

(52) U.S. Cl. ..... 205/363; 205/364; 205/366; 205/367; 205/368; 205/371; 205/372; 205/397; 205/398; 205/401; 205/404; 205/410; 205/47

(58) Field of Search ..... 205/363, 364, 205/366, 367, 368, 371, 372, 397, 398, 401, 410, 402, 404, 47

(56) References Cited

U.S. PATENT DOCUMENTS 4,082,628 A 4/1978 Tokumoto et al.
4,157,285 A 6/1979 Winand
4,187,155 A 2/1980 de Nora et al.

(Continued)

FOREIGN PATENT DOCUMENTS

DE 150557 6/1903
DE 298 22 563 U 2/1999

(Continued)

OTHER PUBLICATIONS

Database WPI, Section Ch, Week 199443, Derwent Publications Ltd., London; AN 1994–347403, XP002169806 & JP 06 271904 A, Sep. 27, 1994.

(Continued)

*Primary Examiner*—Roy King
*Assistant Examiner*—Harry D. Wilkins, III
(74) *Attorney, Agent, or Firm*—Nixon & Vanderhye P.C.

(57) ABSTRACT

A method of removing oxygen from a solid metal, metal compound or semi-metal M1O by electrolysis in a fused salt of M2Y or a mixture of salts, which comprises conducting electrolysis under conditions such that reaction of oxygen rather than M2 deposition occurs at an electrode surface and that oxygen dissolves in the electrolyte M2Y and wherein, M1O is in the form of (sintered) granules or is in the form of a powder which is continuously fed into the fused salt. Also disclosed is a method of producing a metal foam comprising the steps of fabricating a foam-like metal oxide preform, removing oxygen from said foam structured metal oxide preform by electrolysis in a fused salt of M2Y or a mixture of salts, which comprises conducting electrolysis under conditions such that reaction of oxygen rather than M2 deposition occurs at an electrode surface. The method is advantageously applied for the production of titanium from Ti-dioxide.

7 Claims, 2 Drawing Sheets

U.S. PATENT DOCUMENTS

| | | | | | |
|---|---|---|---|---|---|
| 4,400,247 | A | | 8/1983 | Ginatta | |
| 4,837,230 | A | * | 6/1989 | Chen et al. | 501/88 |
| 4,875,985 | A | | 10/1989 | Donahue et al. | |
| 5,167,271 | A | * | 12/1992 | Lange et al. | 164/103 |
| 5,277,973 | A | * | 1/1994 | Yamamura et al. | 428/367 |
| 5,385,760 | A | | 1/1995 | Schassberger et al. | |
| 5,409,580 | A | | 4/1995 | Gesing et al. | |
| 5,733,842 | A | * | 3/1998 | Gerdes et al. | 264/681 |
| 5,848,351 | A | * | 12/1998 | Hoshino et al. | 428/550 |
| 5,861,070 | A | | 1/1999 | Reichman et al. | |
| 5,865,980 | A | | 2/1999 | Ray et al. | |
| 6,180,258 | B1 | * | 1/2001 | Klier | 428/539.5 |

FOREIGN PATENT DOCUMENTS

| | | | | | |
|---|---|---|---|---|---|
| GB | 781803 | | | 8/1957 | |
| GB | 1362991 | | | 8/1974 | |
| GB | 1374832 | | | 11/1974 | |
| GB | 0026666 | A1 | | 4/1981 | |
| JP | 63-130733 | A | * | 6/1988 | C22C/1/09 |
| JP | 10-183203 | | | 7/1998 | |
| JP | 10-251710 | | | 9/1998 | |
| WO | 98/49371 | A1 | | 11/1998 | |
| WO | WO 99/41431 | | | 8/1999 | |
| WO | 99/64638 | A | | 12/1999 | |

OTHER PUBLICATIONS

Database WPI; Section Ch, Week 199837, Derwent Publications Ltd., London; AN 1994–347003, XP002169807, & RU 2 103 391, Jan. 27, 1998.

Database WPI, Section Ch, Week 199851, Derwent Publications Ltd., London, AN 1998–608132, XP002169858, & RU 2 11 935, May 27, 1998.

Takeuchi et al; "Studies in the Electrolytic Reduction of Titanium Dioxide and Titanium Slag"; Nippon Kinzoku Gakkaishi, vol. 28, No. 9, Apr. 17, 1964, pp. 549–554.

Oki et al; "Reduction of Titanium Dioxide by Calcium in Hot Cathode Spot"; Department of Mealllurgical Engineering, May 31, 1967, pp. 164–166.

Chen et al, Nature, vol. 407, Sep. 21, 2000, pp. 361–364.

Sadoway et al, J. Alloys & Compounds, vol. 237, Apr. 15, 1996, pp. 150–154.

Okabe et al, Metallurgical Transactions B. vol. 24B, Jun. 1999, pp. 449–455.

Boghosan et al, Acta Chemica Scandinavica, vol. 45, 1991, pp. 145–157.

* cited by examiner

ELECTROLYTIC REDUCTION OF METAL OXIDES SUCH AS TITANIUM DIOXIDE AND PROCESS APPLICATIONS

This application is the US national phase of international application PCT/GB01/00683 filed Feb. 20, 2001, which designated the US.

The invention relates to improvements in the electrolytic reduction of metal compounds and in particular to improvements in the reduction of titanium dioxide to produce metallic titanium.

International Patent Specification PCT/GB99/01781 describes a method of the removal of oxygen from metals and metal oxides by electrolytic reduction. Subsequently referred to in this document as the 'electrolytic reduction process'. The method involves the electrolysis of the oxide in a fused salt, and wherein the electrolysis is performed under conditions such that the reaction of oxygen rather than the cation of the salt deposition occurs at an electrode surface and such that oxygen dissolves in the electrolyte. The metal oxide or semi-metal oxide to be reduced is in the form of a solid sintered cathode.

The current inventors have developed improvements to this process which greatly enhance the efficiency and usefulness of the general technique.

The general technique is described as follows: a method of removing oxygen from a solid metal, metal compound or semi-metal $M_1O$ by electrolysis in a fused salt of $M_2Y$ or a mixture of salts, which comprises conducting electrolysis under conditions such that reaction of oxygen rather than $M_2$ deposition occurs at an electrode surface and that oxygen dissolves in the electrolyte $M_2Y$.

$M_1$ may be selected from the group comprising Ti, Zr, Hf, Al, Mg, U, Nd, Mo, Cr, Nb, Ge, P, As, Si, Sb, Sm or any alloy thereof. $M_2$ may be any of Ca, Ba, Li, Cs, Sr. Y is Cl.

The invention will now be described by way of examples only and with reference to the following figures of which:

PRODUCTION OF POWDER BY REDUCTION OF SINTERED METAL OXIDE GRANULES

The inventors have determined that sintered granules or powder of metal oxide, particularly titanium dioxide, or semi-metal oxide can be used as the feedstock for the electrolysis used in the above referenced method, as long as appropriate conditions are present. This has the advantage that it would allow very efficient and direct production of titanium metal powder, which is at present very expensive. In this method, powdered titanium dioxide in the form of granules or powder preferably having a size in the range 10 $\mu$m to 500 $\mu$m diameter; more preferably, in the region of 200 $\mu$m diameter.

A semi-metal is an element that has some characteristics associated with a metal, an example is boron, other semi-metals will be apparent to a person skilled in the art.

Figure 1:
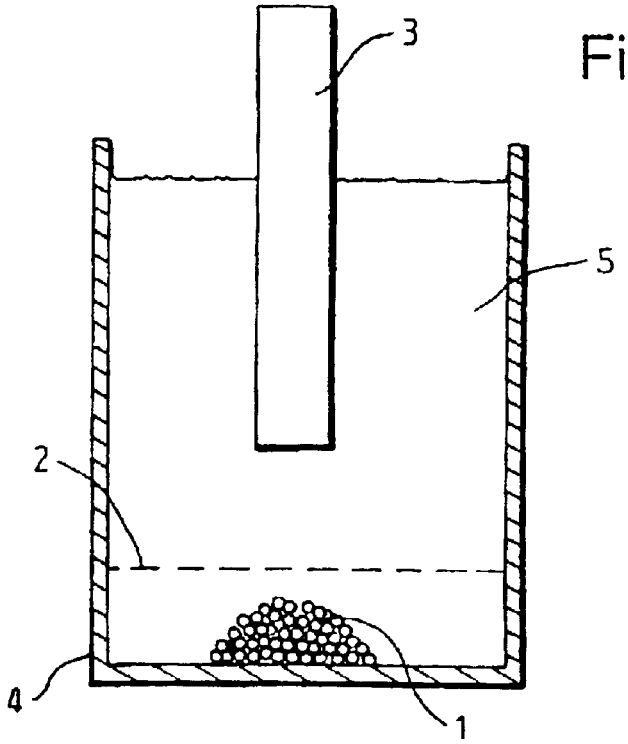
FIG. 1 shows an embodiment wherein the metal oxide to be reduced is in the form of granules or powder.

In an example illustrated by FIG. 1, the granules of titanium dioxide 1, which comprise the cathode, are held in a basket 2 below a carbon anode 3 located in a crucible 4 having a molten salt 5 therein. As the oxide granules or powder particles are reduced to metal they are prevented from sintering together by maintaining particle motion by any appropriate method e.g. in a fluidised bed arrangement. Agitation is provided either by mechanical vibration or by the injection of gas underneath the basket. Mechanical vibration can for example be in the form of ultrasonic transducers mounted on the outside of the crucible or on control rods. The key variables to adjust are the frequency and amplitude of the vibrations in order to get an average particle contact time which is long enough to get reduction, but short enough to prevent diffusion bonding of the particles into a solid mass. Similar principles would apply to the agitation by gas, except here the flow rate of gas and size of the bubbles would be the variables controlling particle contact time. Additional advantages of using this technique are that the batch of powder reduces evenly, and, due to the small size of the particles, rapidly. Also the agitation of the electrolyte helps to improve the reaction rate.

In the above example, titanium is obtained by the method from titanium dioxide. However the method can be applied to most metal oxides to produce the metal powder.

Production of Powder by Deposition of Ti onto the Cathode

The inventor has determined that if titanium is deposited onto a cathode (based on the electrolytic process stated above) from another source of titanium at a more positive potential, the resulting titanium deposited thereon is dendritic in structure. This form of titanium is easy to break up into a powder since individual particles of titanium are connected together by only a small area.

Figure 2:
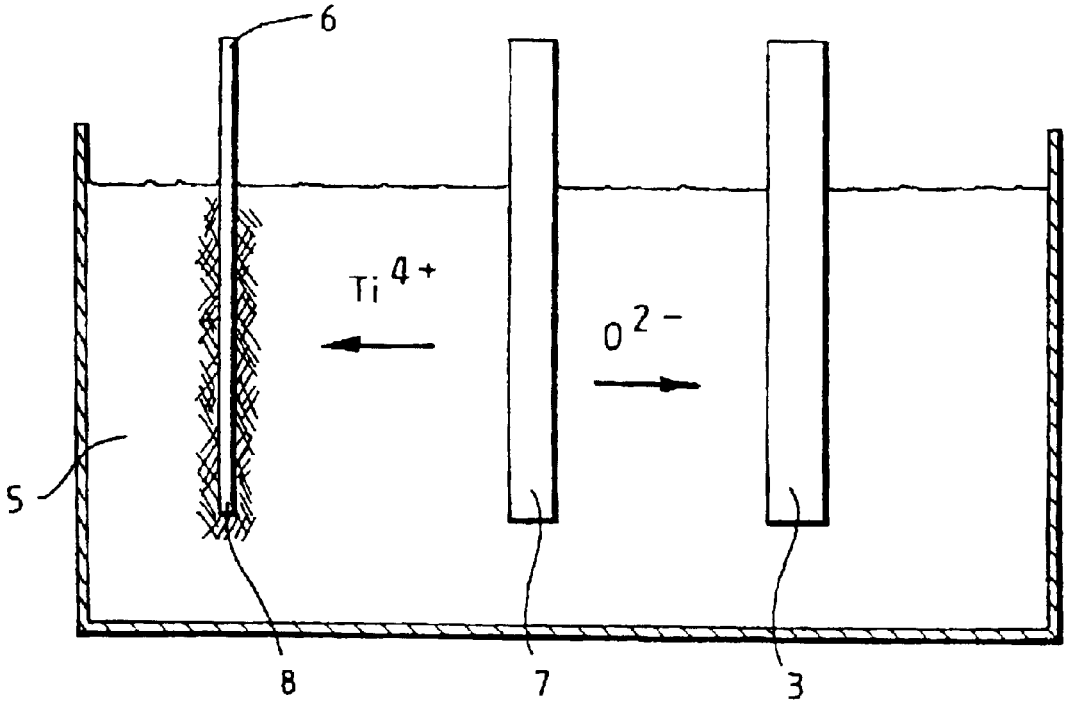
FIG. 2 shows an embodiment wherein an additional cathode is provides in order to refine the metal to the dendritic form.

This effect can be used for producing titanium powder from titania. In this refinement, shown in FIG. 2, of the above referenced method, a second cathode 6 is provided which is maintained at a potential which is more negative than the first cathode 7. When the deposition of titanium on the first cathode has progressed sufficiently, the second electrode is switched on, leading to the dissolution of titanium from the first cathode and deposition onto the second cathode, in dendritic form 8. The other reference numerals represent the same items as in FIG. 1.

The advantage of this process is that dendritic deposited titanium is easily turned into powder. This process will also add an additional refining step in the reduction of titania which should result in a higher product purity.

Use of Continuous Powder Feed

One improvement in the electrolytic process that has been developed by the inventors is of continuously feeding powder or granules of the metal oxide or semi-metal oxide. This allows for a constant current and higher reaction rate. A carbon electrode is preferred for this. Additionally cheaper feedstock can be used because a sintering and/or forming stage may be missed out. The oxide powder or granular feed drop to the bottom of the crucible and are gradually reduced to a semi-solid mass of metal, semi-metal or alloy by the electrolytic process.

Figure 3:
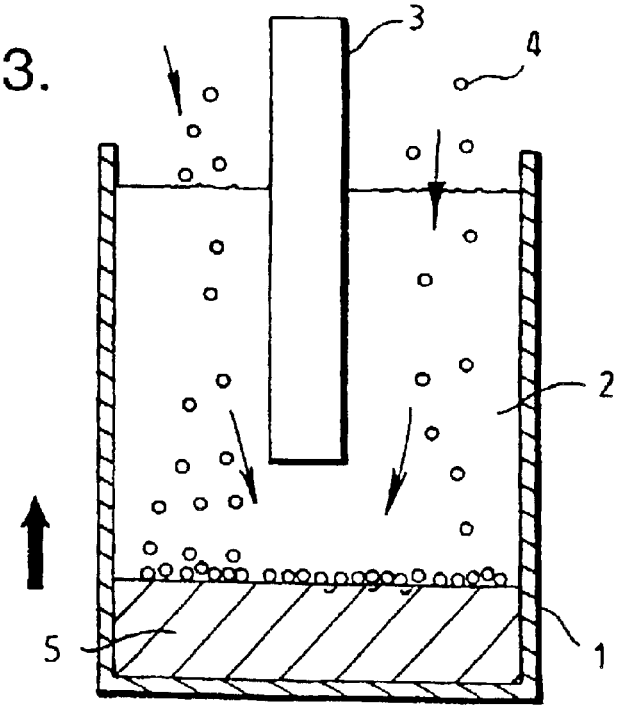
FIG. 3 shows an embodiment showing the use of continuous powder or granular feed.

This method is shown in FIG. 3 which shows a conducting crucible 1 which is made the cathode containing a molten salt 2 and inserted therein is an anode 3. Titanium dioxide powder or granules 4 are fed into the crucible where they undergo reduction at the base of the crucible. The thick arrow shows the increasing thickness of the reduced feedstock 5.

Improved Feedstock for Electrolytic Reduction of Metal Oxide.

A problem with the process described in WO99/64638 is that to get reduction of the oxide electrical contact must be maintained for some time at a temperature at which oxygen diffuses readily. Under these conditions the titanium will diffusion bond to itself resulting in clumps of material stuck together rather than free flowing powder.

The inventors have determined that when the electrolysis is performed on a sintered mass of a mixture of metal oxide substantially comprising particles of size generally greater than 20 microns and finer particles of less than 7 microns, the problem of diffusion bonding is mitigated.

Preferably the finer particles make up between 5 and 70% of the sintered block by weight. More preferably, the finer particles make up between 10 and 55% of the sintered block by weight.

High density granules of approximately the size required for the powder are manufactured and then are mixed with very fine unsintered titanium dioxide, binder and water in the appropriate ratios and formed into the required shape of feedstock. This feedstock is then sintered at to achieve the required strength for the reduction process. The resulting feedstock after sintering but before reduction consists of high density granules in a low density (porous) matrix.

For the sintering stage, the use of such a bimodal distribution of powders in the feedstock is advantageous as it reduces the amount of shrinkage of the shaped feedstock during sintering. This is turn reduces the chances of cracking and disintegration of the shaped feedstock resulting in a reduced number of reject items prior to electrolysis. The required or useable strength of the sintered feedstock for the reduction process is such that the sintered feedstock is strong enough to be handled. When a bimodal distribution is used in the feedstock, as there is a reduction in the cracking and disintegration of the sintered feedstock, there is an increased proportion of sintered feedstock which has the required strength.

The feedstock can be reduced as blocks using the usual method and the result is a friable block which can easily be broken up into powder. The reason for this is that the matrix shrinks considerably during the reduction resulting in a sponge-like structure, but the granules shrink to form a more or less solid structure. The matrix can conduct electricity to the granules but is easily broken after reduction.

The manufacture of titanium dioxide feedstock, either rutile or anatase, from the raw ore (sand mined illemite) by the sulphate route comprises a number of steps.

During one of these steps titanium dioxide in the form of amorphous slurry undergoes calcining. The inventors have determined that titanium dioxide amorphous slurry can be used as the principle feedstock for titanium production by the electrolytic reduction process and has the advantage that it is cheaper to produce than the crystalline, calcined titanium dioxide. The electrolytic process requires the oxide powder feedstock to be sintered into a solid cathode. However it has been found that the amorphous titanium dioxide does not sinter well; it tends to crack and disintegrate even when mixed with an organic binder beforehand. This occurs because of the fine particle size of the amorphous material which prevents close packing of the powder before sintering. The result of this is large shrinkage during the sintering process which results in a friable as-sintered product. However it has been determined that if a small amount of the more expensive calcined material is mixed with the amorphous material and an organic binder satisfactory results after sintering are obtained. This quantity should be at least 5% of the calcined material.

EXAMPLE

About 1 kg of rutile sand (titanium dioxide content 95%) from Richard Bay Minerals, South Africa, with an average particle size of 100 $\mu$m was mixed with 10 wt. % rutile calciner discharge from the company TiOxide (made from the sulphate process) which had been ground in a pestle and mortar to ensure a fine particle agglomerate size. To this was added a further 2 wt. % binder (methyl cellulose) and the whole mix was shaken with a mechanical shaker for 30 minutes to ensure a homogenous feedstock. The resulting material was then mixed with distilled water until the consistency of the paste was about that of putty. This material was then flattened by hand onto a sheet of aluminium foil to a thickness of about 5 mm and then scored, using a scalpel blade, into squares of side 30 mm. This material was then allowed to dry overnight in a drying oven at 70° C. On removal from the oven it was then possible to peel off the foil and break the rutile into squares as marked by the scalpel blade. The binder gives significant strength to the feedstock thus enabling a 5 mm diameter hole to be drilled in the centre of each square for mounting on the electrode at a later stage. Since no shrinkage was anticipated in the sintering stage no allowance for shrinkage in the calculation of the hole size was necessary.

About 50 squares of the rutile were loaded up into a furnace in air at room temperature and the furnace was switched on and allowed to heat at its natural rate to 1300° C. (time to heat up around 30 minutes). After 2 hours at this temperature the furnace was switched off and allowed to cool at its natural rate (about 20° C. per minute initially). When the rutile was below 100° C. it was unloaded from the furnace and stacked onto a M5 threaded stainless steel rod which was to be used as the current carrier. The total amount of rutile loaded was 387 g. The bulk density of the feedstock in this form was measured and found to be 2.33±0.07 kg/l (i.e. 55% dense), and its strength for handling was found to be quite sufficient.

The feedstock was then electrolysed using the process described in the above referenced patent application at up to 3V for 51 hours at an electrolyte temperature of 1000° C. The resulting material after cleaning and removal of the electrode rod had a weight of 214 g. Oxygen and nitrogen analysis indicated that the levels of these interstitials were 800 ppm and 5 ppm respectively. The form of the product was very similar to that of the feedstock except the colour change and slight shrinkage. Due to the process used to manufacture the feedstock the product was friable and could be crushed up using fingers and pliers to a reasonably fine powder. Some of the particles were large therefore the material was passed through a 250 $\mu$m sieve. Approximately 65% by weight of the material was small enough to pass through the 250 $\mu$m sieve after using this simple crushing technique.

The resulting powder was washed in hot water to remove the salt and very fine particles, then it was washed in glacial acetic acid to remove the CaO and then finally in water again to remove the acid. The powder was then dried in a drying oven overnight at 70° C.

The results can be expressed as the concentration of calciner discharge required to achieve useable strength of the feedstock after sintering. At 1300° C. about 10% was required, at 1200° C. about 25% was required and at 1000° C. at least 50% was required although this still gave a very weak feedstock.

The calciner discharge used can be replaced by cheaper amorphous $TiO_2$. The key requirement for this 'matrix' material is that it sinters easily with significant shrinkage during the sintering process. Any oxide or mixture of oxides which fulfil these criteria would be usable. For $TiO_2$ this means the particle size must be less than about 1 $\mu$m. It is estimated that at least 5% calcined material should be present in order to give any significant strength to the sintered product.

The starting granules need not be rutile sand but could be manufactured by a sintering and crushing process, and in principle there is no reason to suppose that alloy powders could not be made by this route. Other metal powders could also presumably be made by this route.

Production of Metal Foam

The inventors have determined that a metal or semi-metal foam may be manufactured by electrolysis using the above referenced method. Initially, a foam-like metal oxide or semi-metal oxide preform is fabricated, followed by removing oxygen from said foam structured metal oxide preform by electrolysis in a fused salt $M_2Y$ or a mixture of salts, which comprises conducting electrolysis under conditions such that reaction of oxygen rather than $M_2$ deposition occurs at an electrode surface and that oxygen dissolves in the electrolyte $M_2Y$.

Titanium foams are attractive for a number of applications such as filters, medical implants and structural fillers. Until now however, no reliable method has been found for their manufacture. Partially sintered alloy powder is similar to a foam but is expensive to produce due to the high cost of titanium alloy powder, and the porosity that can be achieved is limited to about 40%.

The inventors have determined that if one fabricates a foam-like sintered titanium dioxide preform this can be reduced to a solid metal foam by using the electrolysis method above. Various established methods could be used to produce a foam like titanium dioxide material from the titanium dioxide powder. It is a requirement that the foam preform must have open porosity i.e. interconnected and open to the exterior.

In a preferred embodiment, a natural or synthetic polymeric foam is infiltrated with metal (e.g. titanium) or semi-metal oxide slip, dried and fired to remove the organic foam, leaving an open 'foam' which is an inverse of the original organic foam. The sintered preform is then electrolytically reduced to convert it into a titanium or titanium alloy foam. This is then washed or vacuum distilled to remove the salt.

In an alternative method, metal oxide or semi-metal oxide powder is mixed with organic foaming agents. These materials are typically two liquids which when mixed, react to evolve a foaming gas, and then cure to give a solidified foam with either an open or closed structure. The metal or semi-metal powder is mixed with one or both of the precursor liquids prior to production of the foam. The foam is then fired to remove the organic material, leaving ceramic foam. This is then electrolytically reduced to give a metal, semi-metal or alloy foam.

Production of Alloy Metal Matrix Composites (MMC's)

The manufacture of metal, semi-metal or alloy MMC reinforced with ceramic fibres or particles such as borides, carbides and nitrides is known to be difficult and expensive. For SiC fibre reinforced titanium alloy MMC's, existing methods all use solid state diffusion bonding to produce a 100% dense composite and differ only in the way the metal and fibre is combined prior to hot pressing. Current methods introduce the metal in the form of foil, wire, or powder, or by plasma spray droplets onto arrays of fibres, or by vapour coating of individual fibres with metal, semi-metal or alloy.

For a particulate reinforced titanium alloy MMC, the preferred traditional production route is by mixing of powders and hot pressing. Liquid phase processing is not normally favourable, because of problems with the size and distribution of phases formed from the liquid phase. However, it is also difficult to achieve an even distribution of ceramic particles by blending of metal and ceramic powders, particularly when the powders are of different size ranges, which is invariably the case with titanium powder. In the proposed method, fine ceramic particles such as titanium diboride are blended with titanium dioxide powder to give a uniform mixture prior to sintering and electrolytic reduction. After reduction the product is washed or vacuum annealed to remove salt, and then hot pressed to give a 100% dense composite material. Depending on the reaction chemistries, the ceramic particles either remain unchanged by the electrolysis and hot pressing or would be converted to another ceramic material which would then be the reinforcement. For example, on the case of titanium diboride, the ceramic reacts with the titanium to form titanium monoboride. In a variation of the new process, fine metal powder is mixed with the titanium dioxide powder in place of a ceramic reinforcement powder, with the intention of forming a fine distribution of a hard ceramic or intermetallic phase by reaction with titanium or another alloying element or elements. For example, boron powder can be added, and this reacts to form titanium monoboride particles in the titanium alloy.

The inventors have determined that in order to produce a fibre reinforced MMC, individual SiC fibres can be coated with an oxide/binder slurry (or mixed oxide slurry for an alloy) of the appropriate thickness, or the fibres can be combined with oxide paste or slurry to produce a preformed sheet consisting of parallel fibres in a matrix of oxide powder and binder or a complex three dimensional shape containing the silicon fibres in the correct positions could be cast or pressed from oxide slurry or paste. The coated fibre, preform sheet or three dimensional shape can then be made the cathode of an electrolytic cell (with or without a pre-sinter step) and the titanium dioxide would be reduced by the electrolytic process to a metal or alloy coating on the fibre. The product can then be washed or vacuum annealed to remove the salt and then hot isostatically pressed to give a 100% dense fibre reinforced composite.

Production of Metal, Semi-metal or Alloy Components

The inventors have determined that a metal or semi-metal or alloy component may be manufactured by electrolysis using the above referenced method.

A near net shape titanium or titanium alloy component is made by electrolytically reducing a ceramic facsimile of the component made from a mixture of titanium dioxide or a mixture of titanium dioxide and the oxides of the appropriate alloying elements. The ceramic facsimile could be produced using any of the well known production methods for ceramic articles, including pressing, injection moulding, extrusion and slip casting, followed by firing (sintering), as described before. Full density of the metallic component would be achieved by sintering, with or without the application of pressure, and either in the electrolytic cell, or in a subsequent operation. Shrinkage of the component during the conversion to metal or alloy would be allowed for by making the ceramic facsimile proportionally larger than the desired component.

This method would have the advantage of producing metal or alloy components near to the final desired net shape, and would avoid costs associated with alternative shaping methods such as machining or forging. The method would be particularly applicable to small intricately shaped components.

What is claimed is:

1. A method of removing oxygen from a metal oxide or semi-metal oxide or a mixture of oxides of appropriate alloying elements to produce a metal, semi-metal or alloy, by electrolysis is a fused salt of $M_2Y$ or a mixture of salts, under conditions so as to remove oxygen, wherein said electrolysis is performed on a sintered mass of a bimodal mixture of said oxide(s) substantially comprising particles of size greater than 20 microns and finer particles of less than 7 microns.

2. A method of electrolytic reduction of metal or semi-metal oxide(s) as claimed in claim 1, wherein said sintered mass is additionally formed by mixing binder and water.

3. A method as claimed in claim 1, wherein said finer particles make up between 5 and 70% of the sintered block by weight.

4. A method as claimed in claim 1, wherein said finer particles make up between 10 and 55% of the sintered block by weight.

5. A method according to claim 1 wherein the metal or semi-metal is selected from the group comprising Ti, Zr, Hf, Al, Mg, U, Nd, Mo, Cr, Nb, Ge, P, As, Si, Sb, Sm or any alloy thereof.

6. A method according to claim 1 wherein $M_2$ is Ca, Ba, Li, Cs, Sr.

7. A method according to claim 1 wherein Y is Cl.

* * * * *